US005252058A

United States Patent [19]

Palm, Jr.

[11] Patent Number: 5,252,058

[45] Date of Patent: Oct. 12, 1993

[54] METHOD AND APPARATUS FOR RECIRCULATING FLUE GAS IN A PULSE COMBUSTOR

[75] Inventor: R. Bramley Palm, Jr., Oswego, N.Y.

[73] Assignee: Fulton Thermatec Corporation, Pulaski, N.Y.

[21] Appl. No.: 940,919

[22] Filed: Sep. 4, 1992

Related U.S. Application Data

[63] Continuation-in-part of Ser. No. 720,633, Jun. 25, 1991, Pat. No. 5,145,354.

[51] Int. Cl.[5] ..... F23C 11/04

[52] U.S. Cl. ..... 431/1; 431/9; 431/116; 126/116 R

[58] Field of Search ..... 431/1, 9, 5, 115, 116; 126/116 R; 122/24; 60/39.77, 247.39.8

[56] References Cited

U.S. PATENT DOCUMENTS

| | | |
|---|---|---|
| 2,115,644 | 4/1938 | Modesse . |
| 2,525,782 | 10/1950 | Dunbar . |
| 2,546,966 | 4/1951 | Bodine, Jr. . |
| 2,748,753 | 6/1956 | Sarrazin et al. . |
| 2,878,790 | 3/1959 | Paris et al. . |
| 2,998,705 | 9/1961 | Porter et al. . |
| 3,171,465 | 3/1965 | Rydberg . |
| 3,183,895 | 5/1965 | Haag . |
| 3,188,804 | 6/1965 | Melenric . |
| 3,606,867 | 9/1971 | Briffa . |
| 3,848,408 | 11/1974 | Tompkins . |
| 3,890,084 | 6/1975 | Voorheis et al. . |
| 4,080,149 | 3/1978 | Wolfe . |
| 4,241,720 | 12/1980 | Kitchen . |
| 4,242,972 | 1/1981 | Sicard . |
| 4,314,444 | 2/1982 | Putnam et al. . |
| 4,331,086 | 5/1982 | Fitch et al. . |
| 4,488,865 | 12/1984 | Davis . |
| 4,569,310 | 2/1986 | Davis . |
| 4,619,601 | 10/1986 | Sumitani . |
| 4,637,792 | 1/1987 | Davis . |
| 4,640,674 | 2/1987 | Kitchen . |
| 4,651,712 | 3/1987 | Davis . |
| 4,659,305 | 4/1987 | Nelson et al. . |
| 4,840,558 | 6/1989 | Saito et al. . |
| 4,851,201 | 7/1989 | Heap et al. . |
| 4,884,963 | 12/1989 | Kardos . |
| 4,926,798 | 5/1990 | Kardos . |
| 4,929,172 | 5/1990 | Zinn et al. . |
| 4,995,376 | 2/1991 | Hanson . |
| 5,038,753 | 8/1991 | Yokoyama et al. . |

*Primary Examiner*—Larry Jones

*Attorney, Agent, or Firm*—Speckman, Pauley & Fejer

[57] ABSTRACT

A method and apparatus for recirculating flue gas in either a vertical or a horizontal pulse combustor which is dedicated to deliberate one-stage pulse combustion. At least one combustion chamber wall defines a mixing region and a combustion chamber which is adjacent the mixing region. A fuel inlet conduit or a fuel/air inlet conduit is used to supply fuel into the mixing region. An air inlet conduit or a fuel/air inlet conduit is used to supply air into the mixing region. Air valves are in communication with the fuel inlet conduit, the air inlet conduit and/or the fuel/air inlet conduit. An ignition source is positioned within with mixing region for igniting the air/fuel mixture and beginning the pulse combustion process. An exhaust system removes flue gas containing products of pulse combustion. A portion of the flue gas produced during pulse combustion is then recirculated to the mixing region.

17 Claims, 11 Drawing Sheets

METHOD AND APPARATUS FOR RECIRCULATING FLUE GAS IN A PULSE COMBUSTOR

This is a continuation-in-part patent application of my co-pending patent application having Ser. No. 07/720,633, filed Jun. 25, 1991, now U.S. Pat. No. 5,145,354.

BACKGROUND OF THE INVENTION

1. Field of the Invention

This invention relates to a method and apparatus for reducing emissions by recirculating flue gas exhausted from a pulse combustor dedicated to deliberate one-stage pulse combustion, where a portion of the flue gas is recirculated to a mixing region, an air inlet or an air decoupler.

2. Description of the Prior Art

Many different apparatuses and methods have been designed to reduce emissions from various types of continuous combustion devices. However, there is still a need for a reliable, controllable pulse combustor which is capable of reducing emissions of nitrogen oxides by effectively recirculating flue gas.

U.S. Pat. No. 4,314,444 discloses a two-stage pulse combustor which recirculates cooled combustion products. Combustion products emitted from a first combustion chamber flow through a resonance tube into a second, larger combustion chamber. After the combustion products flow through the second combustion chamber, they are cooled by a second heat exchanger and then enter a region above a section of the second heat exchanger. A portion of the combustion products are recirculated to the pulse combustors so as to dilute the combustion-sustaining gas. As disclosed by the '444 patent, a central duct positioned around a plurality of combustors is in communication with the region above a section of the second heat exchanger. The combustion products are recirculated through the central duct. The lower portion of the central duct is divided into branch portions where each branch portion corresponds to a pulse combustor. Each branch portion has a channel which leads through an aerodynamic valve and through a conduit section to an aerodynamic valve inlet of a pulse combustor.

U.S. Pat. No. 4,331,086 discloses a starved-air combustor capable of combusting a variety of fuels. An afterburner is connected to an outlet end of a combustion chamber through a duct. Hot combustion gas from the combustion chamber heats and dries fuel within the combustion chamber. U.S. Pat. No. 4,242,972 teaches recirculation of a portion of exhaust gas into the combustion chamber of a continuous combustion furnace. Combustion material and air are fed into the furnace through a feed duct, whereas recycled combustion gas and secondary combustion air are fed through inlets that protrude through a bottom wall of the combustion chamber.

U.S. Pat. No. 4,659,305 discloses a flue gas recirculation system for fire tube boilers where a minor portion of the flue gas is recirculated to a burner. U.S. Pat. No. 4,241,720 teaches a pulse combustor wherein combustion products are withdrawn by an exhaust system. U.S. Pat. No. 4,840,558 discloses a pair of pulse combustors wherein all combustion products are exhausted into an exhaust chamber at a high velocity and are then discharged directly into the environment. U.S. Pat. No. 4,640,674 discloses a pulse combustor which is capable of burning a variety of different fuels.

U.S. Pat. Nos. 4,651,712, 4,637,792, 4,569,310 and 4,488,865 generally disclose pulse combustors which have a floating valve that reciprocates in a combustion chamber in order to regulate supply of a combustible mixture. U.S. Pat. No. 3,890,084 generally discloses a method for reducing nitrogen oxide emissions from furnaces or boiler furnaces. As taught by the '084 patent, a lower burner bank is operated with low excess air and an upper bank is operated with excess air. U.S. Pat. No. 4,851,201 discloses a method for reducing nitrogen oxide emissions from various types of combustion systems and removing nitrogen oxides and sulfur oxides from an effluent stream.

U.S. Pat. No. 2,878,790 discloses an intermittent combustion boiler having a pulse-jet unit with an exhaust pipe that discharges into a convergent-divergent ejector, which first leads into a chamber, then into the atmosphere through a passage. U.S. Pat. Nos. 3,606,867 and 3,171,465 disclose pulsating or intermittent combustion systems. U.S. Pat. Nos. 3,183,895 and 3,848,408 generally teach pulse jet engines or resonance duct burners. U.S. Pat. No. 2,546,966 discloses resonant quarter-wave pulse jet engines of multiple circuit and polyphase character. U.S. Pat. No. 2,525,782 discloses a shock wave trap for multiple combustion chamber reso-jet motors which have an air inlet and discharge nozzle means in combination with a shock wave trap which is in communication with the combustion means. U.S. Pat. Nos. 2,998,705 and 3,188,804 generally disclose valveless combustors. U S. Pat. No. 2,115,644 discloses an apparatus for reestablishing or regulating the power of explosion and combustion engines for aerial navigation, depending upon altitude variations. U.S. Pat. No. 2,748,753 discloses an intermittent combustion boiler with a combustion chamber that is supplied with liquid fuel. The combustion chamber is used for heat generation in a resonant combustion duct and the gases exhausted from the exhaust ducts collect in a common flue or manifold, from which they are sent to a chimney.

None of the above references teach flue gas recirculation in a pulse combustor, particularly a pulse combustor which is dedicated to deliberate one-stage pulse combustion.

SUMMARY OF THE INVENTION

It is an object of this invention to provide a process and apparatus for recirculating flue gas exhausted from a deliberate one-stage pulse combustor.

It is another object of this invention to provide a process and an apparatus for recirculating a portion of the flue gas exhausted from a combustion chamber of a pulse combustor, either directly into or upstream from a mixing region, an air inlet and/or an air decoupler.

The above objects of this invention are achieved with an apparatus for recirculating flue gas in either a vertical or a horizontal pulse combustor dedicated to deliberate one-stage pulse combustion wherein the apparatus has at least one combustion chamber wall defining a mixing region and defining a combustion chamber adjacent to the mixing region. A fuel inlet and an air inlet are in communication with the mixing region. It is also apparent that a combined fuel/air inlet can be used to introduce a premixed fuel/air mixture into the mixing region. Flapper check valves or other suitable types of check valves are preferably mounted within the fuel inlet and the air inlet to prevent backflow of flue gas during pulse combustion. An igniter is positioned within the mixing region or other suitable location for combusting an air/fuel mixture, preferably within the mixing region. Exhaust conduits are in communication with the combustion chamber. The exhaust conduits provide a discharge for flue gas exiting the combustion chamber. From the exhaust conduits, a portion of the flue gas is preferably recirculated into the mixing region.

Each exhaust conduit is preferably secured at a downstream end to an exhaust decoupler. In one preferred embodiment of this invention, at least one recirculation conduit is in communication with the exhaust decoupler and the mixing region. In another preferred embodiment of this invention, the exhaust manifold is in communication with and is interposed between the exhaust conduits and the exhaust decoupler of a horizontal pulse combustor. Additionally, the exhaust decoupler has at least one exhaust outlet which is in communication with the ambient atmosphere. In another preferred embodiment of a horizontal pulse combustor according to this invention, at least one recirculation conduit is secured to the exhaust manifold and is in communication with and the mixing region.

In another embodiment of this invention, a downstream end of the air inlet conduit is in communication with the mixing region. An upstream end of the air inlet conduit is in communication with the air inlet valve. In a preferred embodiment of this invention, at least one recirculation conduit is positioned between and is in communication with the exhaust decoupler and the air inlet conduit. In another preferred embodiment of the horizontal pulse combustor of this invention, each recirculation conduit is positioned between and in communication with the exhaust manifold and the air inlet conduit.

In still another embodiment of this invention, an air decoupler is used to house air that is supplied to the mixing region. At least one air decoupler wall defines an air decoupler chamber. The flapper check valve is preferably positioned within the air decoupler chamber. The air decoupler chamber has an inlet which allows it to communicate with either ambient air or another suitable gas supply. In a preferred embodiment of this invention, each recirculation conduit is in communication with the exhaust decoupler and the air decoupler chamber. In another preferred embodiment of this invention, at least one recirculation conduit is in communication with the exhaust manifold and the air decoupler chamber.

This invention is particularly useful for reducing nitrogen oxide emissions. One embodiment of a method for recirculating flue gas in a pulse combustor dedicated to deliberate one-stage pulse combustion begins with introducing fuel and air into the mixing chamber to form an air/fuel mixture, preferably within the combustion region. Pulse combustion is generated in the combustion chamber and flue gas is produced. The flue gas is exhausted and removed from the combustion chamber. A portion of the flue gas is recirculated from the combustion chamber and either directly or indirectly into the mixing region.

Flue gas is removed from the combustion chamber and is discharged through at least one exhaust conduit, preferably multiple exhaust conduits. The flue gas flows from each exhaust conduit, into an exhaust manifold in a horizontal pulse combustor, and then into an exhaust decoupler. In a preferred embodiment, only a portion of the flue gas is recirculated from the exhaust decoupler into the mixing region. In another preferred embodiment having a horizontal pulse combustor, a portion of the flue gas is recirculated from the exhaust manifold into the mixing region.

In another embodiment of this invention, air is introduced into the mixing region. The flue gas is exhausted from the combustion chamber, preferably into at least one exhaust conduit. The flue gas flows from each exhaust conduit into an exhaust decoupler. A portion of the flue gas is then recirculated from the exhaust decoupler into the air inlet. In another preferred embodiment of a horizontal pulse combustor according to this invention, the portion of flue gas is recirculated from the exhaust manifold into the air inlet.

In still another embodiment of this invention, air from the air decoupler chamber flows into th mixing region. The flue gas from the combustion chamber is exhausted from the combustion chamber into each exhaust conduit. The flue gas from each exhaust conduit flows into an exhaust decoupler. Only a portion of the flue gas is recirculated from the exhaust decoupler into the air decoupler chamber. In another preferred embodiment of a horizontal pulse combustor according to this invention, a portion of the flue gas is recirculated from the exhaust manifold into the air decoupler.

In yet another preferred embodiment according to this invention, the flue gas is recirculated into a combined fuel/air inlet which can be located at the combustion chamber wall near the mixing region, between the combustion chamber wall and a check valve or other suitable device, and/or upstream of any such check valve or other suitable device. It is apparent that the apparatus and process of this invention can function with separate air and fuel inlets which are used to mix fuel and air within the combustion chamber or with combined fuel and air inlets which are used to introduce a premixed fuel/air mixture into the mixing region of the combustion chamber.

BRIEF DESCRIPTION OF THE DRAWINGS

The above mentioned and other features of this invention and the manner of obtaining them will become more apparent, and the invention itself will be best understood by reference to the following description of specific embodiments taken in conjunction, wherein.

DESCRIPTION OF THE PREFERRED EMBODIMENTS

Figure 1:
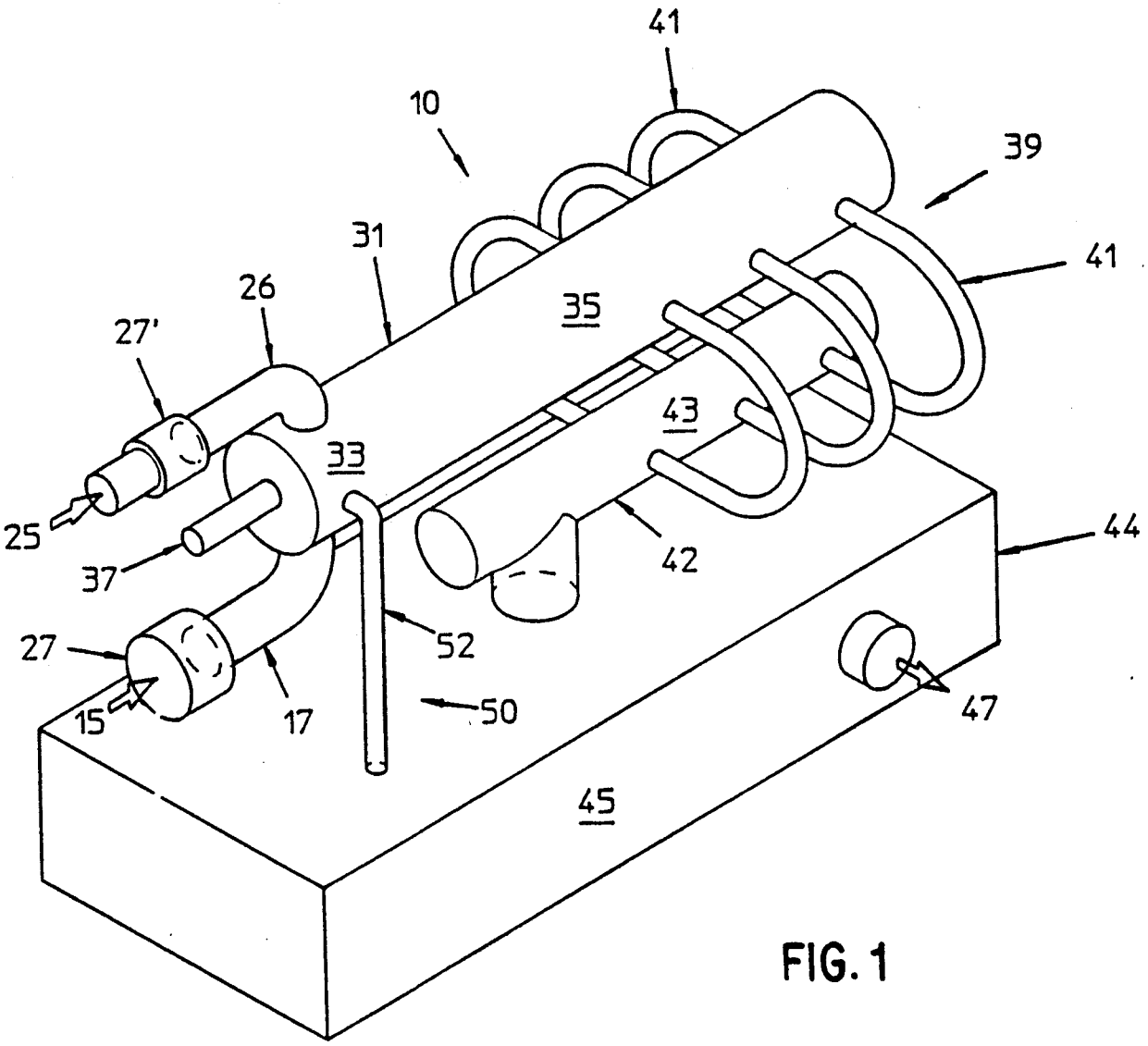
FIG. 1 is a perspective view of an apparatus, according to one embodiment of this invention, for recirculating flue gas, in a horizontal pulse combustor, from an exhaust decoupler into a mixing region of the combustion chamber.
Figure 7:
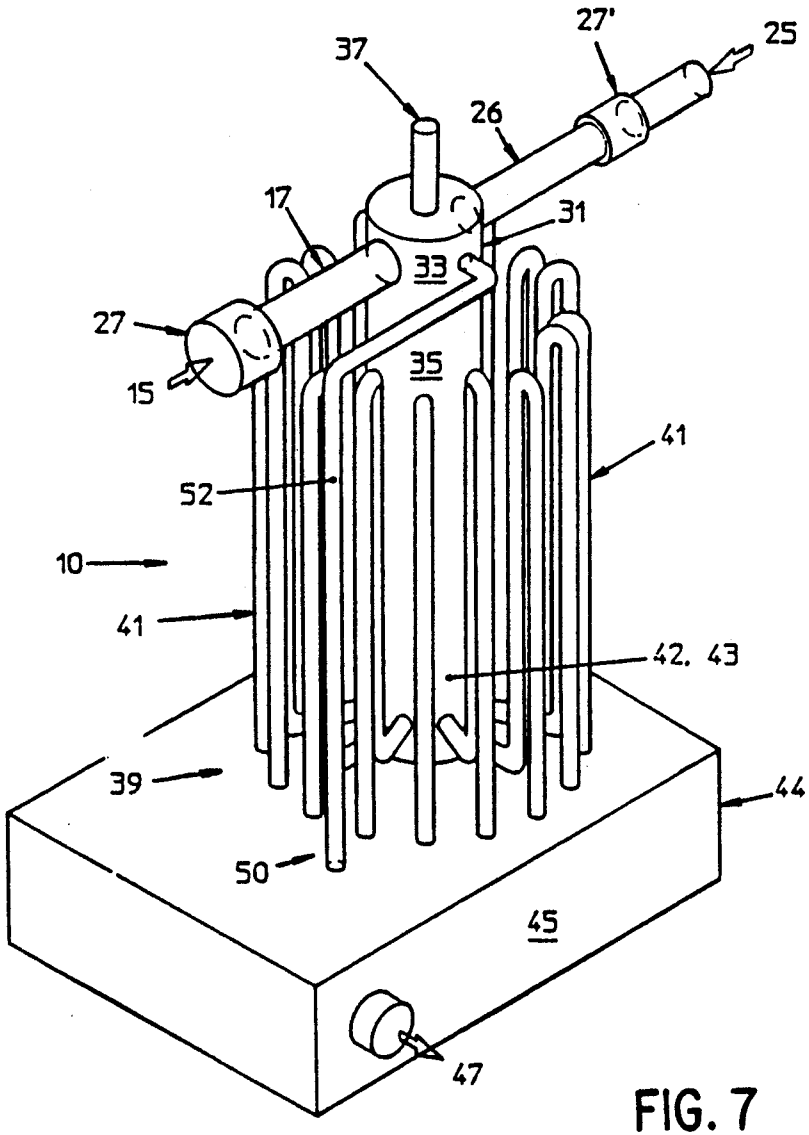
FIG. 7 is a perspective view of an apparatus, according to another preferred embodiment of this invention, for recirculating flue gas, in a vertical pulse combustor, from an exhaust decoupler into a mixing region of the combustion chamber.

FIGS. 1 and 7 illustrate preferred embodiments of an apparatus for recirculating flue gas in pulse combustor 10 which is preferably dedicated to deliberate one-stage pulse combustion. As shown in FIG. 1, pulse combustor 10 is a horizontal pulse combustor and as shown in FIG. 7, pulse combustor 10 is a vertical pulse combustor. For purposes of recirculating flue gas within a pulse combustor dedicated to one-stage pulse combustion according to this invention, pulse combustor 10 operates in a similar manner regardless of whether it has a horizontal or a vertical design.

As shown in FIGS. 1 and 7, combustion chamber wall 31 defines mixing region 33 and combustion chamber 35. Mixing region 33 is preferably adjacent combustion chamber 35, as shown in FIGS. 1–9; however, it is apparent that flue gas recirculation according to this invention may apply to other suitable arrangements of mixing chambers, ignition chambers and/or combustion chambers of pulse combustors. However, for purposes of discussion, the specification and claims generally refer to "mixing region" which can be positioned either as shown in FIGS. 1–11 or in any other suitable manner apparent to those skilled in the art, such as within a separate or remote chamber, within an inlet conduit, between baffle walls within combustion chamber 35, or the like. It is apparent that one or more combustion chamber walls 31 can form any suitable shape of mixing region 33 and combustion chamber 35. As shown in FIGS. 1–11, such combustion chamber walls 31 preferably form cylindrical shapes.

As shown in FIGS. 1 and 7, fuel inlet means 25 is used to supply fuel, for example, natural gas, into mixing region 33. Fuel inlet means 25, which may comprise a fuel inlet conduit 26 or another suitable fuel inlet apparatus, is connected to a fuel source which is not shown. As shown, air inlet means 15 is preferably secured to combustion chamber wall 31 and is in communication with mixing region 33. Air inlet means 15 may include air valve means 27 and air inlet conduit 17, or the like. Although not shown, air inlet means 15 may include one or more other suitable air inlets which are in communication with mixing region 33. Air valve means 27 and fuel valve means 27′ may include a variety of solenoid check valves or flapper check valves which are known to those skilled in the art. Fuel valve means 27′ and air valve means 27 each preferably comprise a flapper check valve or other similar check valve assembly, such as described in U.S. Pat. No. 4,856,558 or U.S. Pat. No. 4,951,706, and each is secured with respect to pulse combustor 10 so as to be in communication with fuel inlet means 25 and air inlet means 15. Air valve means 27 and fuel valve means 27′ prevent backflow of pulse combustion products, fuel and/or air through either air inlet means 15 or fuel inlet means 25.

Figure 10:
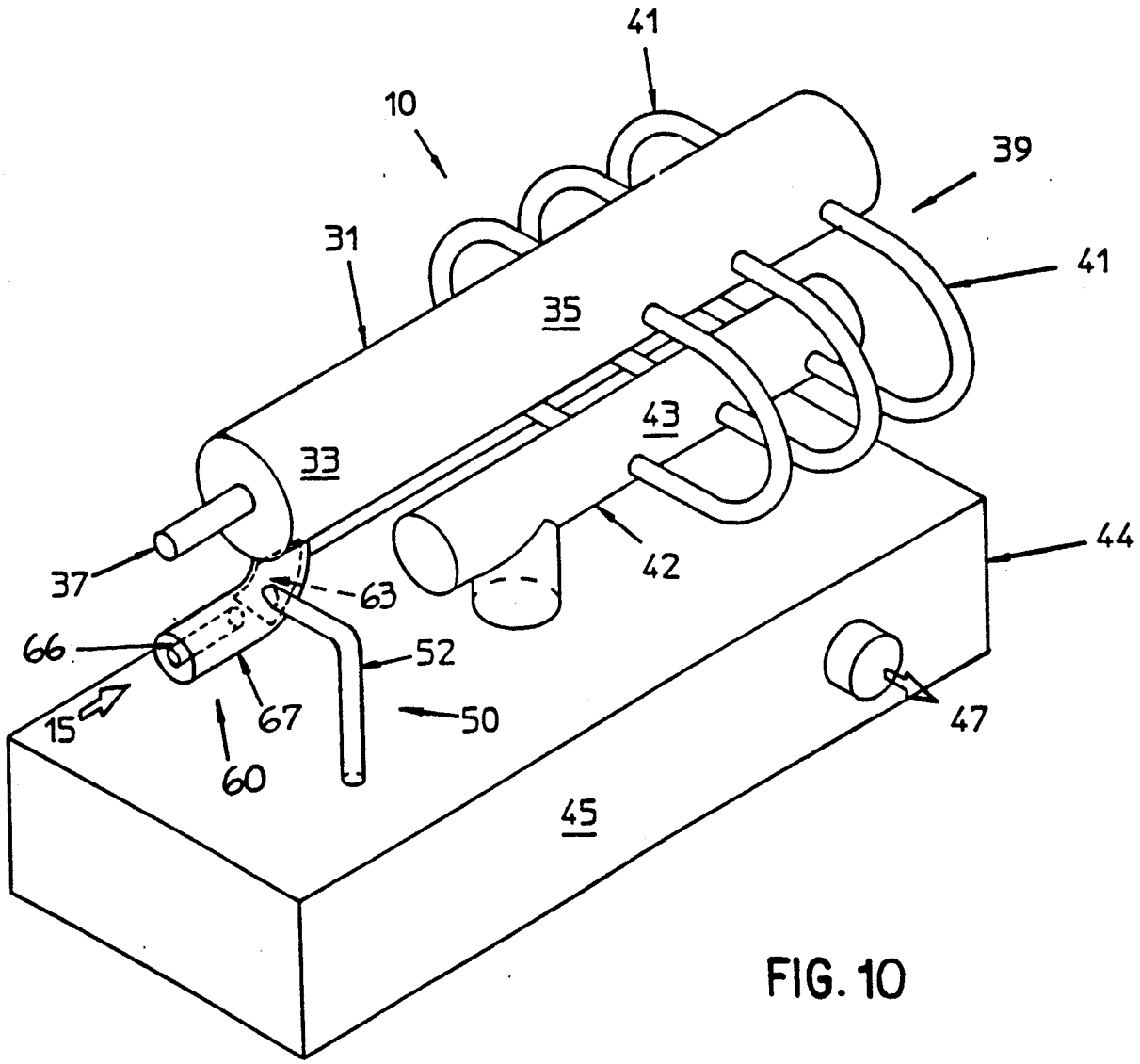
FIG. 10 is a perspective view of an apparatus, according to another preferred embodiment of this invention, for recirculating flue gas, in a horizontal pulse combustor, from an exhaust flue gas supply to a combined fuel/air inlet.
Figure 11:
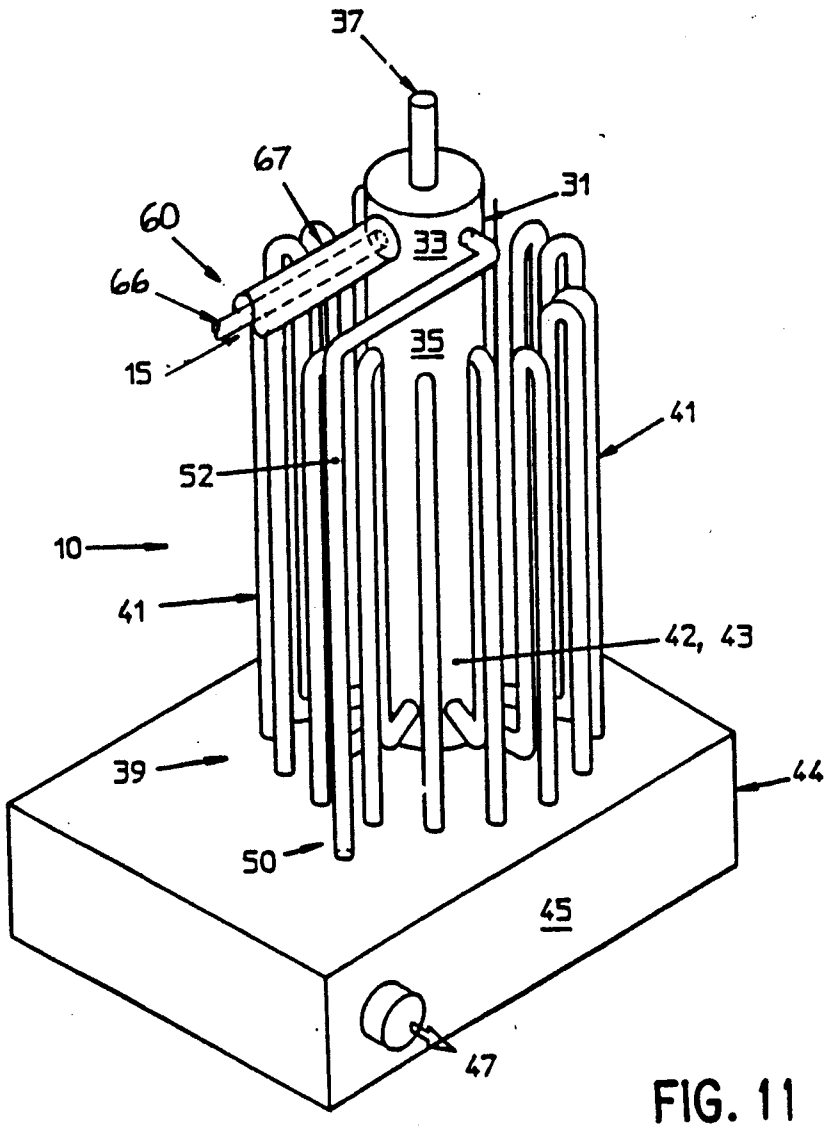
FIG. 11 is a perspective view of an apparatus, according to another preferred embodiment of this invention, for recirculating flue gas, in a vertical pulse combustor, from an exhaust flue gas supply to a combined fuel/air inlet.

According to another preferred embodiment of this invention, air inlet means 15 and fuel inlet means 25 are combined into one conduit or one inlet source which is in communication with mixing region 33, as shown in FIGS. 10 and 11. Such combination results in a premixed air/fuel mixture which is introduced either directly or indirectly into mixing region 33.

According to the preferred embodiment of this invention shown in FIG. 10, fuel/air inlet means 60 comprise fuel inlet conduit 6 mounted within air inlet conduit 67. As shown in FIG. 10, the downstream end of fuel inlet conduit 66 terminates at a fixed distance upstream of combustion chamber wall 31. Such arrangement results in the fuel/air mixture premixing within the premix region generally indicated by the dashed region identified by reference numeral 63.

As shown in FIG. 10, recirculation conduit 52 is in communication between exhaust decoupler 45 and mixing region 63. However, it is apparent that the upstream end of recirculation conduit 52 can also be in communication with any other exhaust supply, such as exhaust manifold 43 and/or exhaust conduit 41. Likewise, it is apparent that the downstream end of exhaust conduit 52 can be in direct or indirect communication with mixing region 33, such as by having recirculation conduit 52 in communication with the fuel flow, the air flow and/or the fuel/air mixture flow at a position either upstream or downstream from that shown in FIG. 10.

According to another preferred embodiment of this invention as shown in FIG. 11, fuel conduit 66 extends further downstream within air conduit 67, as that shown in FIG. 10. It is apparent that any suitable arrangement of mixing the fuel and air and/or premixing the fuel and air, apparent to those skilled in the art, can be used in connection with the apparatus and process of this invention. FIGS. 10 and 11 show two preferred embodiments of the structural features of air conduit 66 and fuel conduit 67. However, it is apparent that other suitable physical arrangements can be used to accomplish the same objective of either introducing the fuel and air separately into combustion chamber 35 or as a premixture into combustion chamber 35. FIG. 11 shows one preferred embodiment of recirculation conduit 52. However, it is apparent that recirculation conduit 52 can be positioned between the various points of the exhaust supply, or the flue gas supply, and the fuel and air supply or the fuel/air supply.

With the preferred embodiments shown in FIGS. 10 and 11, it is also apparent that various types of solenoid check valves and/or flapper check valves can be used at suitable positions within fuel inlet conduit 66 and air inlet conduit 67.

Ignition means 37 is preferably positioned within mixing region 33. Ignition means 37 provides a spark or other ignition source for combusting the air/fuel mixture, preferably within mixing region 33. Ignition means 37 may include one or more spark plugs, glow plugs or another suitable igniter.

As shown in FIGS. 1 and 7, exhaust means 39 is secured to combustion chamber wall 31 and is in communication with a downstream portion of combustion chamber 35. Exhaust means 39 is used to discharge combustion products or the flue gas, produced during pulse combustion, from combustion chamber 35. In the embodiments as shown in FIGS. 1 and 7, exhaust means 39 comprise at least one but preferably a plurality of exhaust conduits 41. An upstream end of each exhaust conduit 41 of horizontal pulse combustor 10, as shown in FIG. 1, is secured to combustion chamber wall 31 and is in communication with combustion chamber 35. A downstream end of each exhaust conduit 41 is secured to exhaust manifold wall 42 and is in communication with exhaust manifold 43. Exhaust manifold 43 is in communication with and positioned between each exhaust conduit 41 and exhaust decoupler 45. A downstream end of each exhaust conduit 41 of vertical pulse combustor 10, as shown in FIG. 7, is secured directly to and is in communication with exhaust decoupler 45. Exhaust decoupler 45 has at least one exhaust decoupler outlet 47 which is in communication with an ambient atmosphere.

Recirculation means 50 are used to recirculate a portion of the flue gas from exhaust means 39 into mixing region 33 of pulse combustor 10. In the preferred embodiments of this invention as shown in FIGS. 1–11, the recirculation means includes at least one recirculation conduit 52. Each recirculation conduit 52 has an upstream end secured to exhaust decoupler wall 44 and is in communication with exhaust decoupler 45. A downstream end of each recirculation conduit 52 is secured to combustion chamber wall 31 and is in communication with mixing region 33. As shown in the drawings, only one recirculation conduit 52 is used to recirculate the flue gas from exhaust decoupler 45 to mixing region 33; however, throughout each embodiment of this invention, it is apparent that one or more recirculation conduits 52 may be used to recirculate the flue gas.

Figure 2:
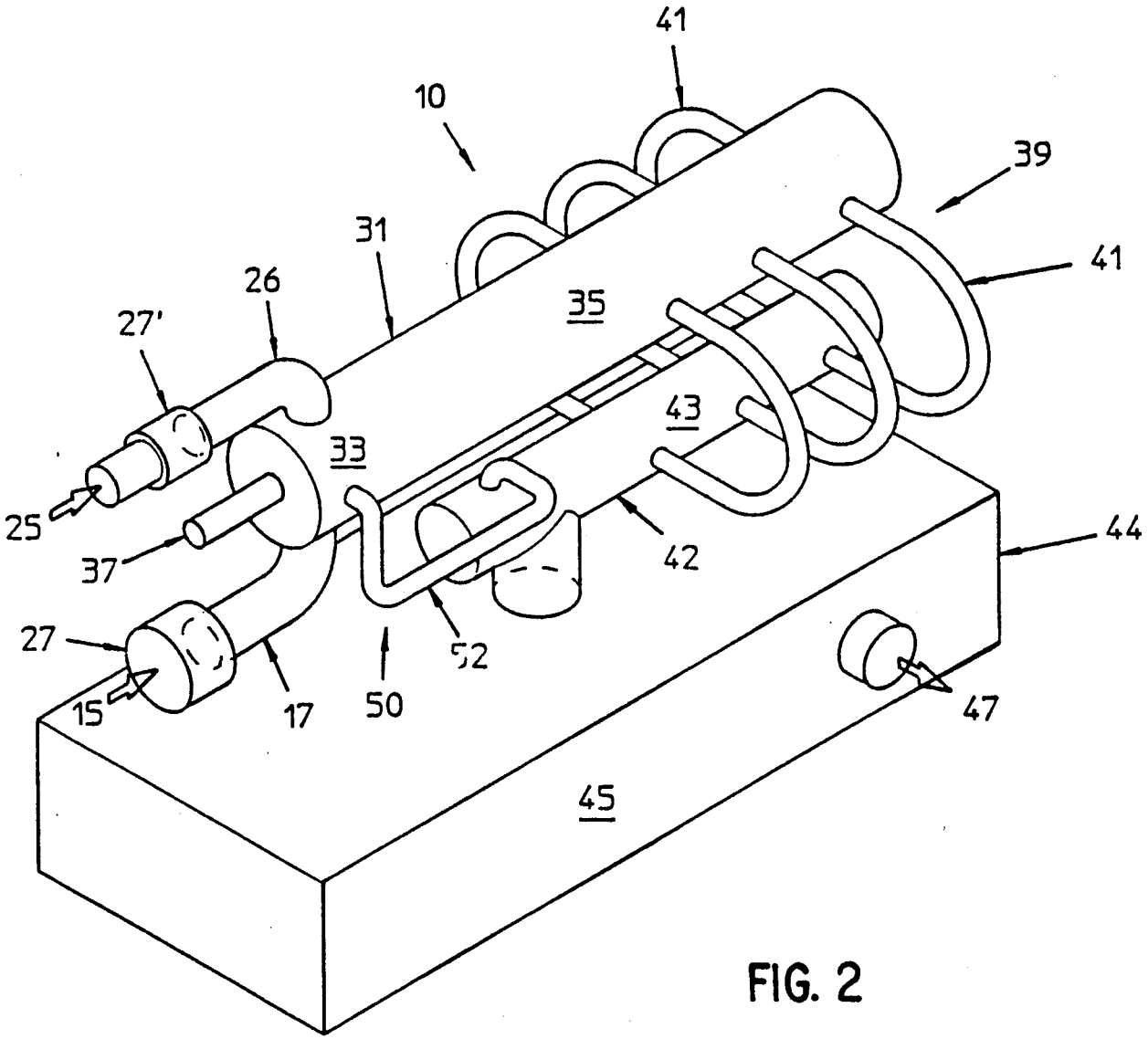
FIG. 2 is a perspective view of an apparatus, according to another embodiment of this invention, for recirculating flue gas, in a horizontal pulse combustor, from an exhaust manifold into a mixing region of the combustion chamber.
Figure 3:
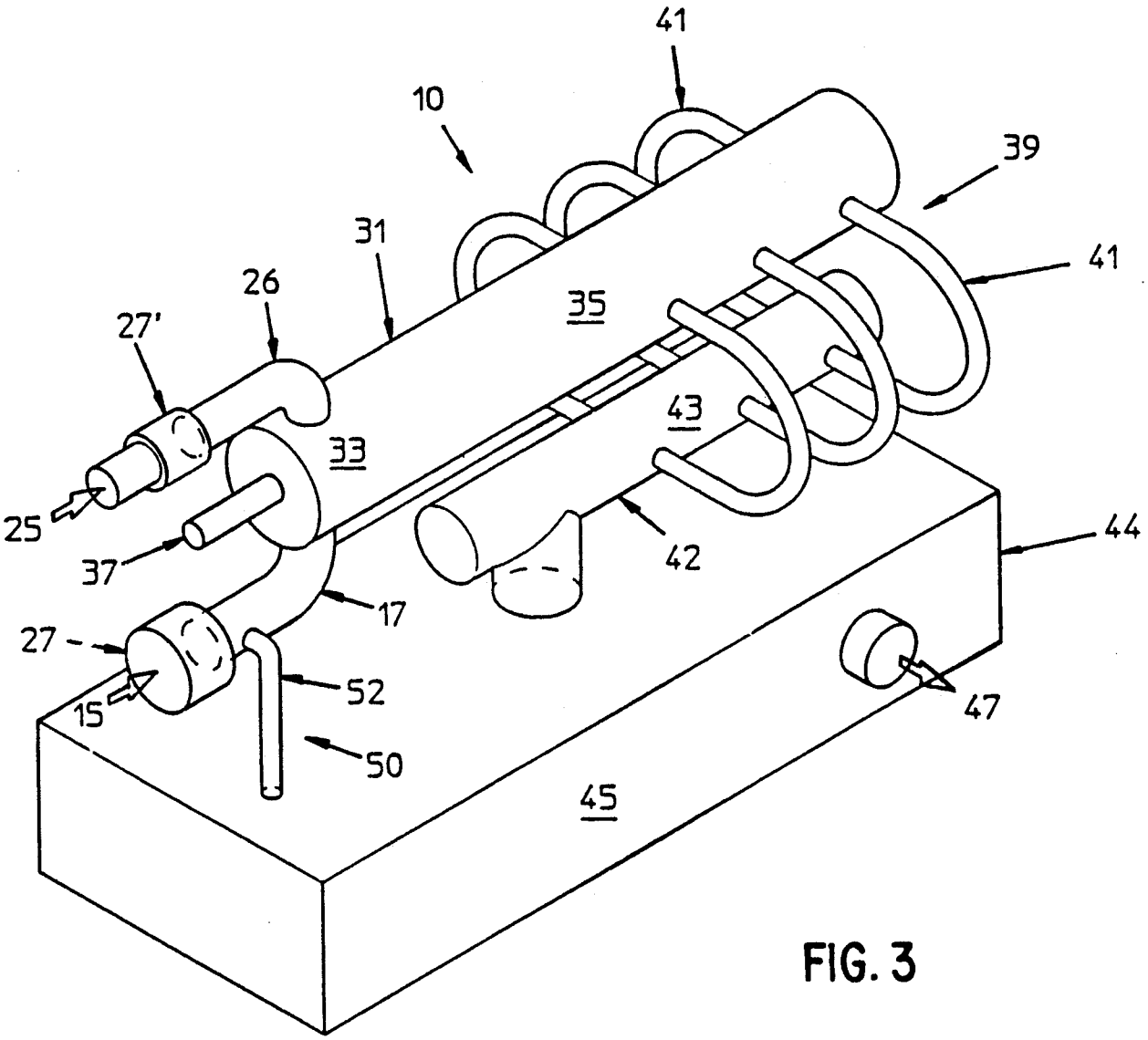
FIG. 3 is a perspective view of an apparatus, according to another embodiment of this invention, for recirculating flue gas, in a horizontal pulse combustor, from an exhaust decoupler into an air inlet conduit.
Figure 8:
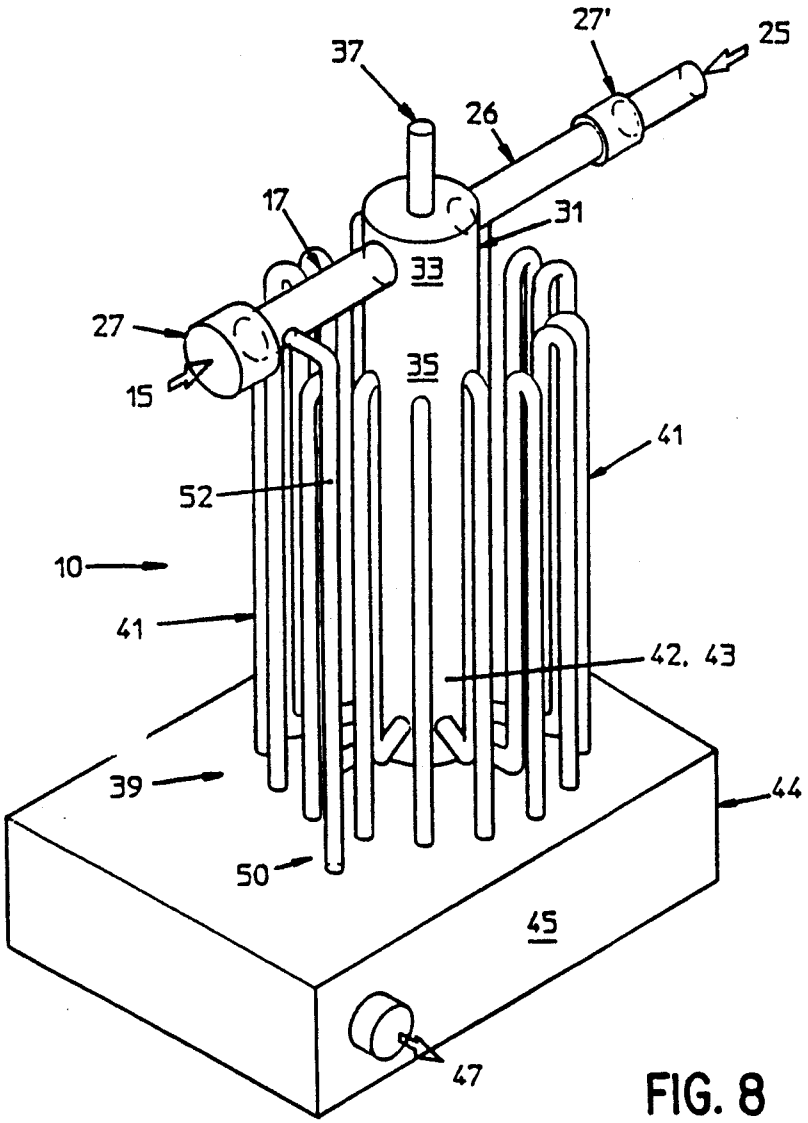
FIG. 8 is a perspective view of an apparatus, according to yet another preferred embodiment of this invention, for recirculating flue gas, in a vertical pulse combustor, from an exhaust decoupler into an air inlet conduit.

In another preferred embodiment of this invention, as illustrated in FIG. 2, the flue gas is recirculated from exhaust manifold 43 directly into mixing region 33. The upstream end of each recirculation conduit 52 is secured to exhaust manifold wall 42 and is in communication with exhaust manifold 43. In other preferred embodiments according to this invention, as illustrated in FIGS. 3 and 8, the upstream end of each recirculation conduit 52 is secured to exhaust decoupler wall 44 and is in communication with exhaust decoupler 45 while the downstream end of recirculation conduit 52 is secured to and in communication with air inlet conduit 17.

Figure 4:
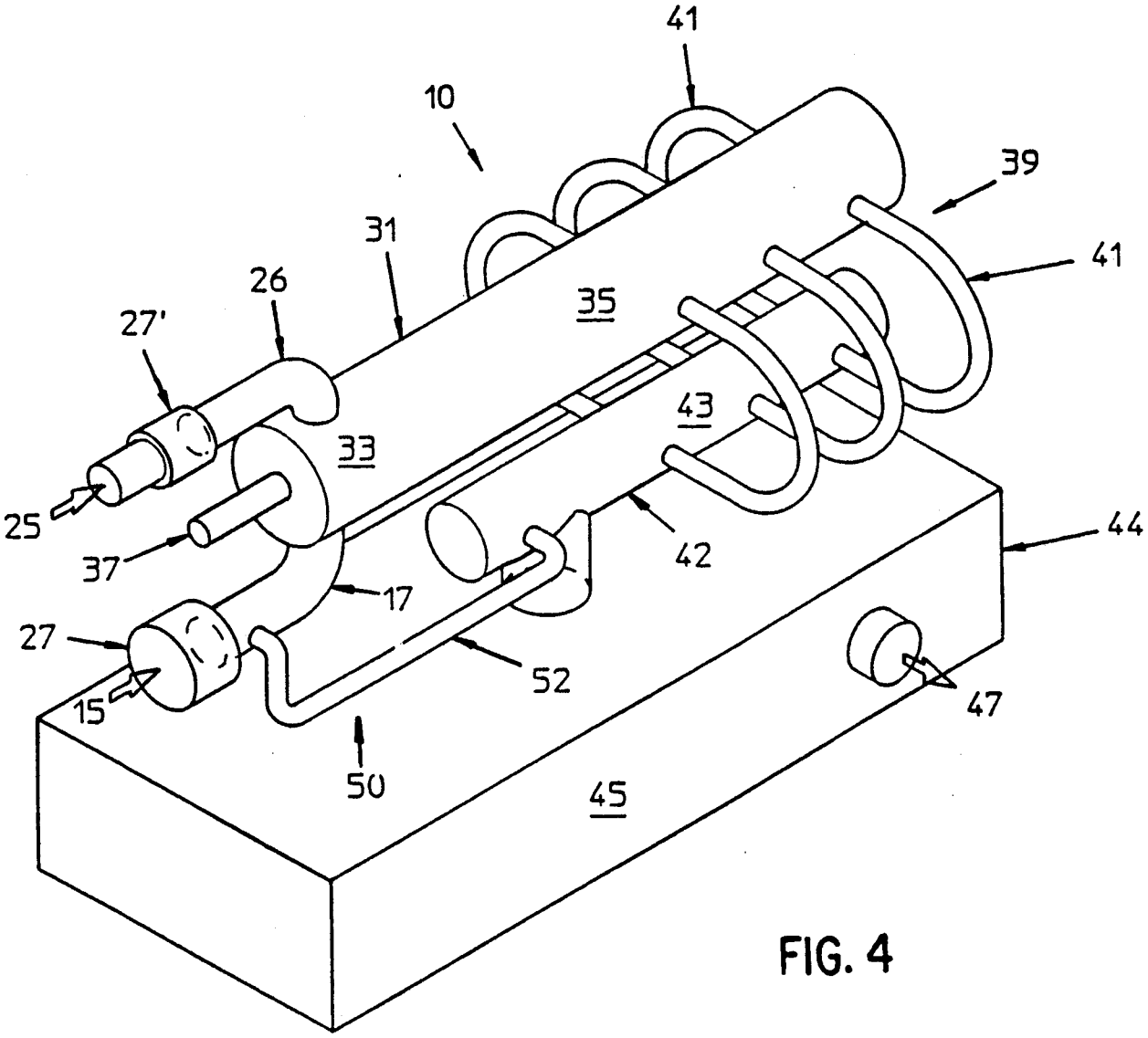
FIG. 4 is a perspective view of an apparatus, according to another embodiment of this invention, for recirculating flue gas, in a horizontal pulse combustor, from an exhaust manifold into an air inlet conduit.

In yet another preferred embodiment of this invention, as shown in FIG. 4, the upstream end of each recirculation conduit 52 is secured to exhaust manifold wall 42 and is in communication with exhaust manifold 43 while the downstream end is secured to and in communication with air inlet conduit 17. It is apparent that the downstream end of each recirculation conduit 52 may be secured to and in communication with a plurality of air inlet conduits 17.

Figure 5:
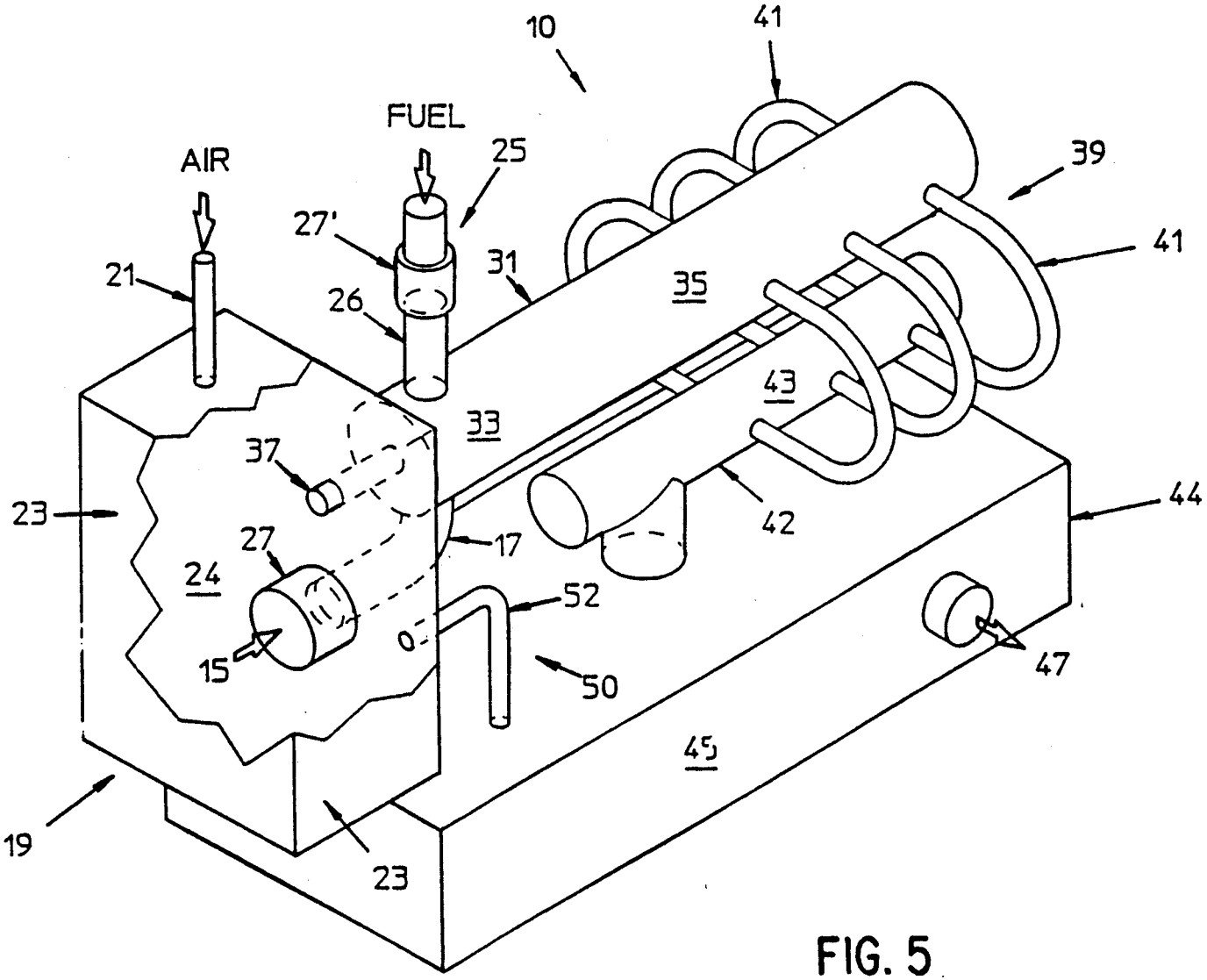
FIG. 5 is a perspective view of an apparatus, according to another embodiment of this invention, for recirculating flue gas, in a horizontal pulse combustor, from an exhaust decoupler into an air decoupler.
Figure 6:
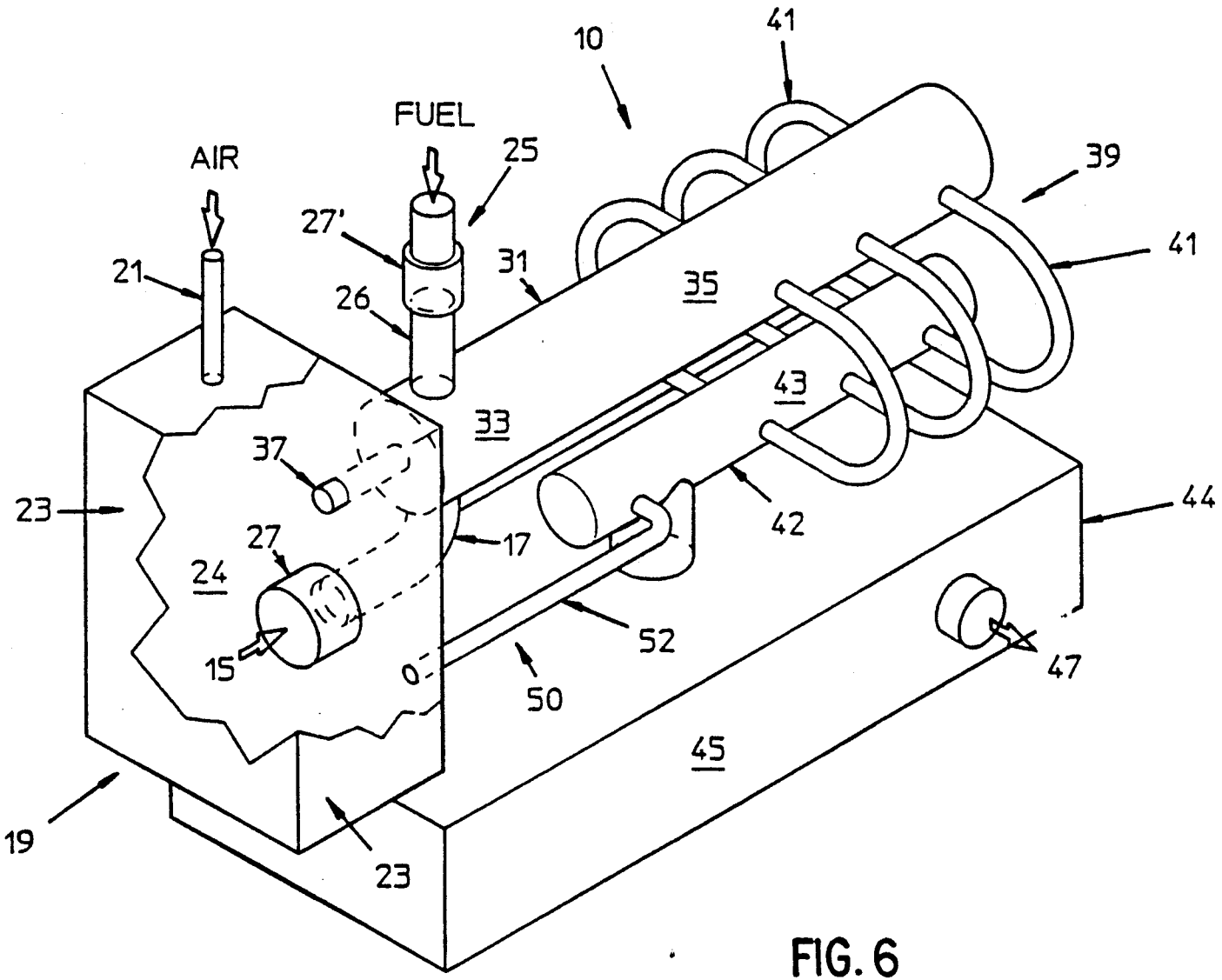
FIG. 6 is a perspective view of an apparatus, according to yet another embodiment of this invention, for recirculating flue gas, in a horizontal pulse combustor, from an exhaust manifold into an air decoupler.
Figure 9:
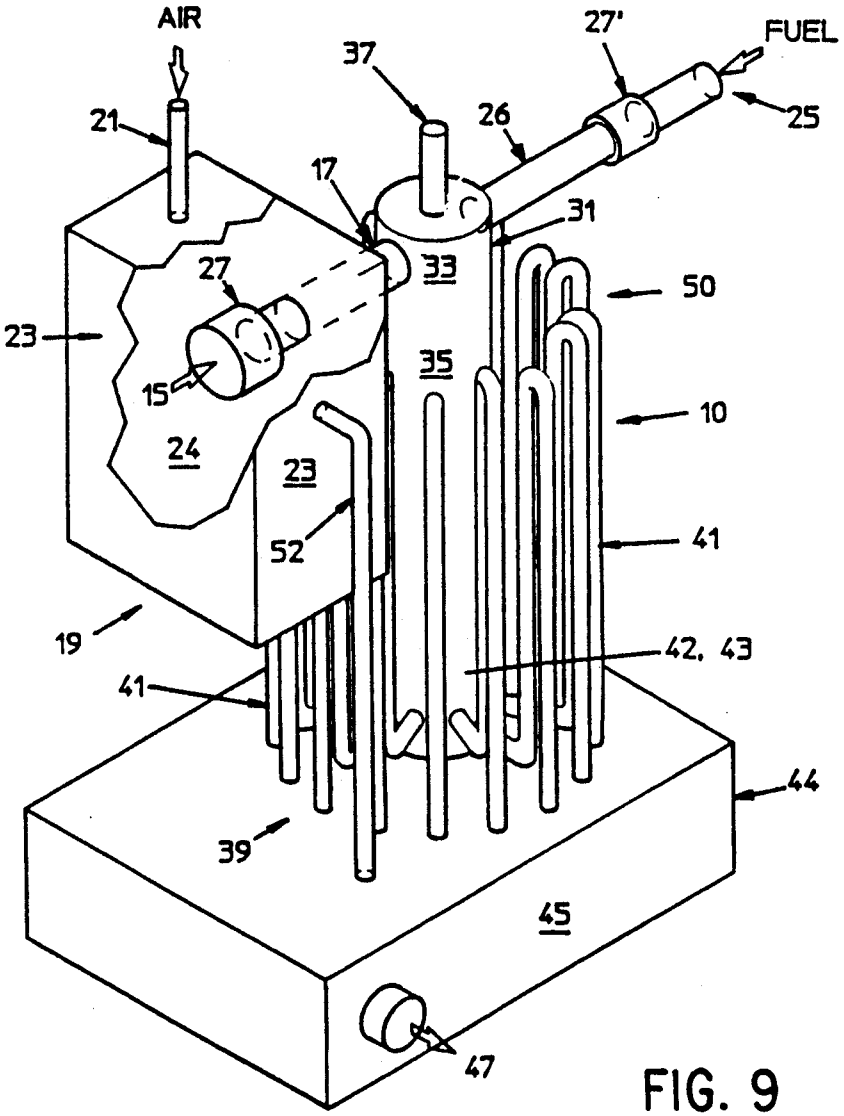
FIG. 9 is a perspective view of an apparatus, according to still another preferred embodiment of this invention, for recirculating flue gas, in a vertical pulse combustor, form an exhaust decoupler into an air decoupler.

In the preferred embodiments of this invention as shown in FIGS. 5 and 9, at least one air decoupler wall 23 of air decoupler 19 defines air decoupler chamber 24. Air valve means 27 are mounted within air decoupler chamber 24 and are in communication with air inlet conduit 17. Air decoupler chamber 24 is preferably in communication with an ambient atmosphere or any other suitable combustible gas or mixture of air and combustible gas. In the embodiments shown in FIGS. 5 and 9, the upstream end of each recirculation conduit 52 is secured to exhaust decoupler wall 44 and is in communication with exhaust decoupler 45 while each downstream end is in communication with air decoupler chamber 24. In still another preferred embodiment of this invention, as illustrated in FIG. 6, the upstream end of each recirculation conduit 52 is secured to exhaust manifold wall 42 and is in communication with exhaust manifold 43 and air decoupler chamber 24. The size and number of recirculation conduits 52 may vary as a function of the desired amount of recirculated flue gas.

This specification teaches many of the elements secured to certain walls, such as air inlet conduit 17 secured to combustion chamber wall 31, as shown in FIG. 1, and recirculation conduit 52 secured to combustion exhaust decoupler wall 44, also as shown in FIG. 2. However, it is apparent that communication between the defined spaces can be accomplished indirectly by having such elements secured to other intervening elements, such as filters, valves and the like. By use of the phrase "secured to" as used in the specification and claims, it is intended that two components are secured either directly to each other or indirectly with respect to each other.

According to one preferred embodiment of this invention, a method for recirculating flue gas in pulse combustor 10, which is preferably dedicated to deliberate one-stage pulse combustion, begins with introducing fuel into mixing region 33 of pulse combustor 10. Throughout this specification and the claims, mixing region 33 is the preferred space within combustion chamber 35 for introducing, mixing and igniting fuel and air; however, it is apparent that the fuel and air can be introduced, mixed and/or ignited in other defined chambers either within or in communication with combustion chamber 35. It is also apparent that mixing region 33 can have positions other than those shown in the drawings or discussed in this specification. Such other positions would be those which are apparent to persons skilled in the art of combustion. Pulse combustion is generated within combustion chamber 35 in either the manner described in this specification or in any other suitable manner known to those skilled in the art of combustion. A portion of the combustion products or flue gas produced during pulse combustion is recirculated from combustion chamber 35 and either directly or indirectly introduced into mixing region 33.

According to one preferred method of this invention, the flue gas exhausted from combustion chamber 35 flows through at least one but preferably a plurality of exhaust conduits 41. With respect to the horizontal pulse combustors 10 as shown in FIGS. 1–6, the flue gas flows from each exhaust conduit 41 into exhaust manifold 43, then into exhaust decoupler 45. It is apparent that the vertical pulse combustors 10 of FIGS. 7–9 and 11 do not have an exhaust manifold and thus the flue gas does not flow through such component. According to the embodiments of FIGS. 1 and 7, a portion of the flue gas is recirculated from exhaust decoupler 45 into mixing region 33. In another preferred method according to this invention, such as in an apparatus as illustrated in FIG. 2, the portion of flue gas is recirculated from exhaust manifold 43 directly into mixing region 33. As illustrated in FIGS. 3 and 8, the portion of flue gas is recirculated from exhaust decoupler 45, into air inlet conduit 17, then into mixing region 33. In another preferred method of this invention, as shown in FIG. 4, the portion of flue gas is recirculated from exhaust manifold 43 into air inlet conduit 17. It is important to note that the net result of introducing at least a portion of the flue gas into mixing region 33, either directly or indirectly from the flue gas supply, is an important aspect of this invention.

In the methods of this invention operating in the apparatuses as shown in FIGS. 5 and 9, a portion of the flue gas is recirculated from exhaust decoupler 45 into air decoupler chamber 24. As shown in FIG. 6, the portion of flue gas is recirculated from exhaust manifold 43 into air decoupler chamber 24.

In the embodiments and methods according to this invention, approximately four to eight percent of the flue gas produced during pulse combustion is recirculated. Such quantities of flue gas recirculation have proven extremely effective in reducing nitrogen oxide emissions. The quantity of flue gas recirculation can be controlled by sizing each recirculation conduit 52, by control valves, or by any other suitable method, control system or apparatus known in the art. According to the method and apparatus of this invention, nitrogen oxide emissions are lowered, relative to conventional pulse combustors, by as much as thirty percent or more.

According to the teachings of this invention, the flue gas may be recirculated from exhaust conduits 41, exhaust manifold 43 and/or exhaust decoupler 45, or any other suitable flue gas supply into either mixing region 33, air inlet means 15, air decoupler chamber 24 or any other suitable inlet means upstream from the point of ignition within combustion chamber 45. For example, flue gas may be recirculated into mixing region 33 and air inlet means 15 or into air decoupler chamber 24 and mixing region 33, as well as other suitable combinations.

While in the forgoing specification this invention has been described in relation to certain preferred embodiments thereof, and many details have been set forth for purpose of illustration, it will be apparent to those skilled in the art that this invention is susceptible to additional embodiments and that certain of the details described herein can be varied considerably without departing from the basic principles of this invention.

I claim:

1. An apparatus for recirculating flue gas in a pulse combustor dedicated to deliberate one-stage pulse combustion, said apparatus comprising:

at least one combustion chamber wall defining a single stage combustion chamber having a single stage mixing zone and a single stage combustion zone in communication with each other;

fuel/air inlet means for introducing a fuel/air mixture into said single stage mixing zone;

valve means for preventing backflow within said fuel/air inlet means during pulse combustion within said single stage combustion chamber, said valve means in communication with said fuel/air inlet means;

ignition means for igniting said fuel/air mixture within said single stage combustion chamber;

exhaust means for discharging flue gas from said single stage combustion zone, said exhaust means in communication with said single stage combustion chamber; and recirculation means for recirculating a portion of said flue gas from said exhaust means to said single stage mixing zone.

2. An apparatus according to claim 1 wherein said exhaust means comprise at least one exhaust conduit in communication with said single stage combustion chamber and an exhaust decoupler.

3. An apparatus according to claim 2 wherein said recirculation means further comprise at least one recirculation conduit in communication with said exhaust decoupler and said single stage mixing zone.

4. An apparatus according to claim 2 further comprising an exhaust manifold in communication with and interposed between each said exhaust conduit and said exhaust decoupler, and said exhaust decoupler having at least one exhaust outlet in communication with ambient air.

5. An apparatus according to claim 4 wherein said recirculation means further comprise at least one recirculation conduit in communication with said exhaust manifold and said single stage mixing zone.

6. An apparatus according to claim 1 wherein said air inlet means further comprise a fuel/air inlet conduit, an upstream end of said fuel/air inlet conduit in communication with said single stage mixing zone, and a downstream end of said fuel/air inlet conduit in communication with said valve means.

7. An apparatus according to claim 6 wherein said recirculation means further comprise at least one recirculation conduit secured to an exhaust decoupler wall of said exhaust decoupler and said fuel/air inlet conduit, and each said recirculation conduit in communication with said exhaust decoupler and said air inlet conduit.

8. An apparatus according to claim 6 further comprising an air decoupler, at least one air decoupler wall of said air decoupler defining an air decoupler chamber, said valve means positioned within said air decoupler chamber, and air decoupler inlet means in communication with an ambient atmosphere and with said air decoupler chamber.

9. An apparatus according to claim 8 wherein said recirculation means further comprise at least one recirculation conduit in communication with said exhaust decoupler and said air decoupler chamber.

10. An apparatus according to claim 8 wherein said recirculation means further comprise at least one recirculation conduit in communication with said exhaust manifold and said air decoupler chamber.

11. An apparatus according to claim 1 wherein said fuel/air inlet means comprise a fuel inlet conduit mounted within an air inlet conduit.

12. An apparatus for recirculating flue gas in a pulse combustor dedicated to deliberate one-stage pulse combustion, said apparatus comprising:

at least one combustion chamber wall defining a mixing region and a combustion chamber, said mixing region adjacent said combustion chamber;

fuel inlet means for introducing fuel into said mixing region;

air inlet means for introducing air into said mixing region, said air inlet means comprising an air inlet conduit, an upstream end of said air inlet conduit in communication with said mixing region, and a downstream end of said air inlet conduit in communication with said valve means;

valve means for preventing backflow within said fuel inlet means and said air inlet means during pulse combustion, said valve means in communication with said fuel inlet means and said air inlet means;

ignition means for igniting an air/fuel mixture within said combustion chamber;

exhaust means for removing said flue gas from said combustion chamber; and recirculation means for recirculating a portion of said flue gas from said exhaust means to said mixing region, said recirculation means comprising at least one recirculation conduit in communication between said exhaust means and said air inlet conduit.

13. In an apparatus for recirculating flue gas in a pulse combustor dedicated to deliberate one-stage pulse combustion having at least one combustion chamber wall defining a single stage combustion chamber having a single stage mixing zone and a single stage combustion zone in communication with each other, fuel inlet means in communication with said single stage mixing zone, air inlet means in communication with said single stage mixing zone, valve means for preventing backflow within said fuel inlet means and said air inlet means during pulse combustion within said single stage combustion chamber, said valve means in communication with said fuel inlet means and said air inlet means, ignition means for igniting an air/fuel mixture within said single stage combustion chamber, exhaust means for removing said flue gas from said single stage combustion chamber, said exhaust means in communication with said single stage combustion chamber, the improvement comprising:

recirculation for recirculating a portion of said flue gas from said exhaust means to said single stage mixing zone.

14. A method for recirculating flue gas in a pulse combustor dedicated to deliberate one-stage pulse combustion, said method comprising the steps of:

introducing a fuel/air mixture into a single stage mixing zone of a single stage combustion chamber of the pulse combustor;

generating pulse combustion in said single stage combustion chamber of the pulse combustor and thereby producing the flue gas;

exhausting the flue gas from the single stage combustion chamber; and recirculating a portion of the flue gas from the single stage combustion chamber to the single stage mixing zone.

15. A method according to claim 14 further comprising the step of premixing fuel and air to form the fuel/air mixture upstream of the single stage mixing zone.

16. A method according to claim 14 wherein exhausting the flue gas from the single stage combustion chamber comprises the additional steps of:

exhausting the flue gas from the single stage combustion chamber into an exhaust supply; and recirculating the portion of flue gas from the exhaust supply to the single stage mixing zone.

17. In a method for recirculating flue gas in a pulse combustor dedicated to one-stage pulse combustion, wherein fuel and air are introduced into a single stage mixing zone of a single stage combustion chamber of the pulse combustor, pulse combustion is generated in the single stage combustion chamber thereby producing flue gas, and the flue gas is exhausted from the single stage combustion chamber, the improvement comprising:

recirculating a portion of the flue gas from the single stage combustion chamber to the single stage mixing zone.

* * * * *